US006305419B1

(12) United States Patent
Krieger et al.

(10) Patent No.: US 6,305,419 B1
(45) Date of Patent: Oct. 23, 2001

(54) VARIABLE PILOT PRESSURE CONTROL FOR PILOT VALVES

(75) Inventors: Daniel J. Krieger; Michael D. Wetzel, both of Bismarck, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 09/616,000

(22) Filed: Jul. 14, 2000

(51) Int. Cl.[7] ..... F15B 13/00
(52) U.S. Cl. ..... 137/625.6; 60/431; 137/565.16
(58) Field of Search ..... 60/431; 137/565.16, 137/625.6

(56) References Cited

U.S. PATENT DOCUMENTS

| | | | |
|---|---|---|---|
| 3,783,611 | 1/1974 | Bojas | 60/19 |
| 3,891,354 | 6/1975 | Bosch | 417/216 |
| 4,128,827 | 12/1978 | Coleman et al. | 340/52 R |
| 4,158,290 | 6/1979 | Cornell | 60/445 |
| 4,180,979 | 1/1980 | Cornell | 60/395 |
| 4,274,257 | 6/1981 | Koch, Jr. et al. | 60/431 |
| 4,337,587 | 7/1982 | Presley | 37/83 |
| 4,368,798 | 1/1983 | Meyerle et al. | 180/307 |
| 4,448,021 | 5/1984 | Hawkins | 60/449 |
| 4,523,892 | 6/1985 | Mitchell et al. | 417/34 |
| 4,559,778 | 12/1985 | Krusche | 60/447 |
| 4,596,118 | 6/1986 | Heiser | 60/431 |
| 4,727,490 | 2/1988 | Narita et al. | 364/424.1 |
| 4,849,583 | 7/1989 | Meyer | 200/6 |
| 4,914,592 | 4/1990 | Callahan et al. | 364/424.05 |
| 5,184,466 | 2/1993 | Schniederjan et al. | 60/448 |
| 5,184,646 | 2/1993 | Hori et al. | 137/636.2 |
| 5,198,800 | 3/1993 | Tozawa et al. | 340/573 |
| 5,303,551 | 4/1994 | Lee | 60/431 |
| 5,308,219 | 5/1994 | Lee et al. | 414/695.5 |
| 5,361,211 | 11/1994 | Lee et al. | 364/424.07 |
| 5,377,777 | 1/1995 | Moore et al. | 180/272 |
| 5,390,759 | 2/1995 | Gollner | 180/307 |
| 5,468,126 | 11/1995 | Lukich | 417/53 |
| 5,527,156 | 6/1996 | Song | 417/2 |
| 5,647,247 | 7/1997 | Magrini | 74/471 |
| 5,727,387 | 3/1998 | Hosseini et al. | 60/327 |
| 5,737,993 | 4/1998 | Cobo et al. | 91/361 |

*Primary Examiner*—Gerald A. Michalsky
(74) *Attorney, Agent, or Firm*—Westman, Champlin & Kelly, P.A.

(57) ABSTRACT

A hydraulically operated industrial machine has hydraulic work components such as a boom, bucket or the like, and also uses hydraulic motors for propelling the machine. The motors and cylinders are controlled by pilot pressure valves to provide pressure to pilot operated valves. A pressure reducing valve is utilized for providing hydraulic fluid at a pilot pressure to the pilot valves. The reducing valve regulates the pilot pressure as a function of one or more parameters indicating the consumption of hydraulic power in the system, such as drive engine speed, or other signals including oil temperature, throttle position, and, if desired, feedback signals from the system.

11 Claims, 4 Drawing Sheets

VARIABLE PILOT PRESSURE CONTROL FOR PILOT VALVES

BACKGROUND OF THE INVENTION

The present invention relates to regulating the pilot pressure that is provided as pilot pressure to a manually controlled pilot valve, which when opened in turn provides pilot pressure to operate main control valves to control flow of hydraulic fluid under pressure to various hydraulic components. Specifically the pilot valves control operation of ground drive hydraulic motors for an excavator, or another industrial vehicle, such as a skid steer loader. The manual control can be joysticks, thumb switches, pivoting operator levers or pedals.

Joysticks that control pilot valves are used for operating various hydraulic components at the present time, such as hydraulic motors that are used for ground drives and cylinders that are used for implement functions. Other controls also are used on vehicles for operating pilot valves that would in turn provide a pilot pressure to a pilot operated main valve, to control the vehicle including the speed and direction. In the case of skid steer loaders, a pump for the drive motors is controlled to limit its displacement under high load conditions by reducing the pressure available to stroke a drive motor servo piston or servo controlled pump, or a variable output main valve or control, such as a swash plate. The position of the servo piston or other controlled component in turn determines the flow rate of the pump, which in turn determines the speed of operation of the travel motor. The travel pump presently has a mechanical pressure reducing valve at its input to limit the pilot pressure supplied to the travel controllers when loads on the ground drive are high. The pilot pressure is controlled by a pump speed sensing hydraulic valve, that supplies a pilot pressure that is linearly proportional to the pump speed, which means that as the pump slows down from high loads, the pilot pressure for the travel motor pilot operated valves is reduced. In turn this limits the flow or output of the pilot valve control servo piston or pumps or the controlled valve, so less power is consumed for travel. This system has drawbacks at low speed throttle positions, because the pump speed sensor valve cannot distinguish between idle, when the pump is turned slowly by the drive engine, and high loads when the pump slows down from loading. Further, the prior art system cannot compensate well for changes in oil temperature, since oil viscosity is reduced as temperature increases and flow and pressure developed may be less at the same pump speed when the oil is hot.

In the case of pilot valve joystick controls, such as that on a mini-excavator, the pressure to pilot valves controlled by the joystick presently flows through an on/off solenoid valve, so that when the solenoid valve is on, full pilot pressure is provided to a pilot pressure operated main control valve or servo piston/pump, and when the solenoid valve is off, there is no pilot pressure and the pilot operated main controls are not moved, so travel is stopped.

It is desirable to limit the horsepower requirements of the hydraulic system so that the engine does not stall under any operating condition.

SUMMARY OF THE INVENTION

The present invention relates to reducing the pilot pressure provided to pilot valves controlled by a joystick or other travel controller on an industrial machine, through the use of a pulse width modulated (PWM) solenoid valve on the pilot pressure line. The output pulses to the PWM solenoid from a controller will determine the opening of the PWM solenoid valve. Pulse width modulated valves are known, and are used in various applications. The PWM valves will respond to open as a function of the pulse width of a train of pulses, and normally will open in proportion to the width (or duration) of the pulses. The electronic controller that provides output pulses in response to input signals can be primarily responsive to engine speed of the engine driving the hydraulic system pump. Other inputs can be used, such as oil temperature, and throttle position, and feedback signals such as measured pilot pressure and drive axle speed.

The electronic controllers are logic circuits or micro processors which will deliver an output pulse train in response to the values of input signals, as selected. For example, an increase in engine speed when used as an input would provide longer pulses (or greater pulse width), so that the pilot pressure being provided to the desired pilot valves will be close to the maximum pilot pressure. As engine speed drops, the pulse width of the output pulse train would be reduced, and the pilot pressure provided to the pilot valves would also be reduced. Likewise, for additional inputs, an increase in oil temperature would result in a greater opening of the PMW valve. The throttle position also would be sensed so that a more open throttle would provide for an increase in the pulse width, and a greater pilot pressure would be provided to the pilot valve and the controllers, such as a joystick.

Feedback signals that would indicate the actual pilot pressure could be provided so that when a desired pilot pressure is reached, the pulse width would be maintained as a maximum. Axle speed signals also could be provided as a feedback to close the control loop and maintain the pilot pressure when the axle speed was at a desired level or increase pilot pressure as the axle speed started to drop.

Piston motors can create demands for hydraulic flow and pressure that are high enough to stall the engine. Reducing the pilot pressure to travel pilot valves and controllers in response to signals that indicate engine loading increases horsepower available for operating components such as a loader or excavator boom, or a bucket. The power used for travel is reduced without stopping the travel entirely. This provides a more satisfactory operation than straight on/off pilot pressure control where all travel is stopped. It also is more sensitive to actual conditions when pilot pressure is adjusted in response to an input.

DETAILED DESCRIPTION OF THE ILLUSTRATIVE EMBODIMENTS

Figure 1:
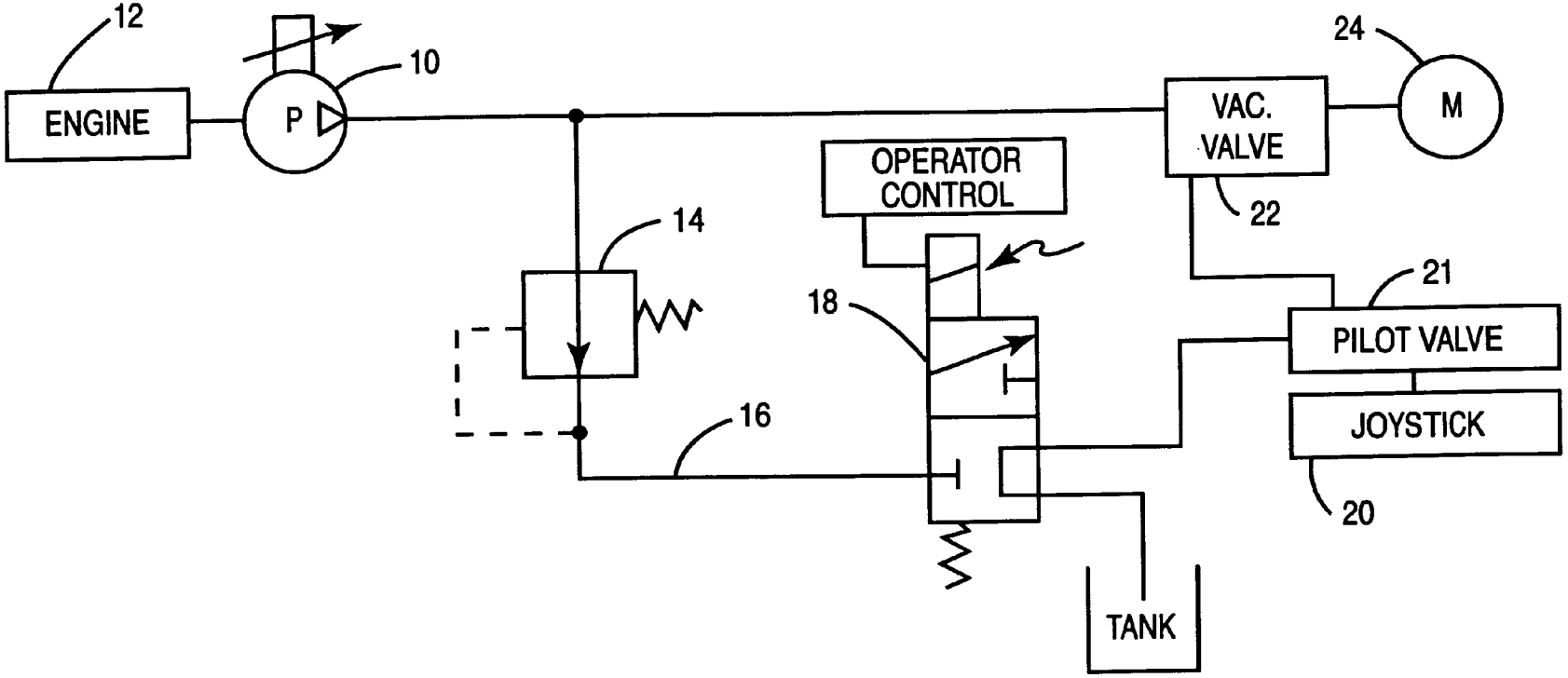
FIG. 1 PRIOR ART
FIG. 1 is a schematic representation of an existing, prior art control for providing pilot pressure to pilot valve controllers of an industrial vehicle.
Figure 2:
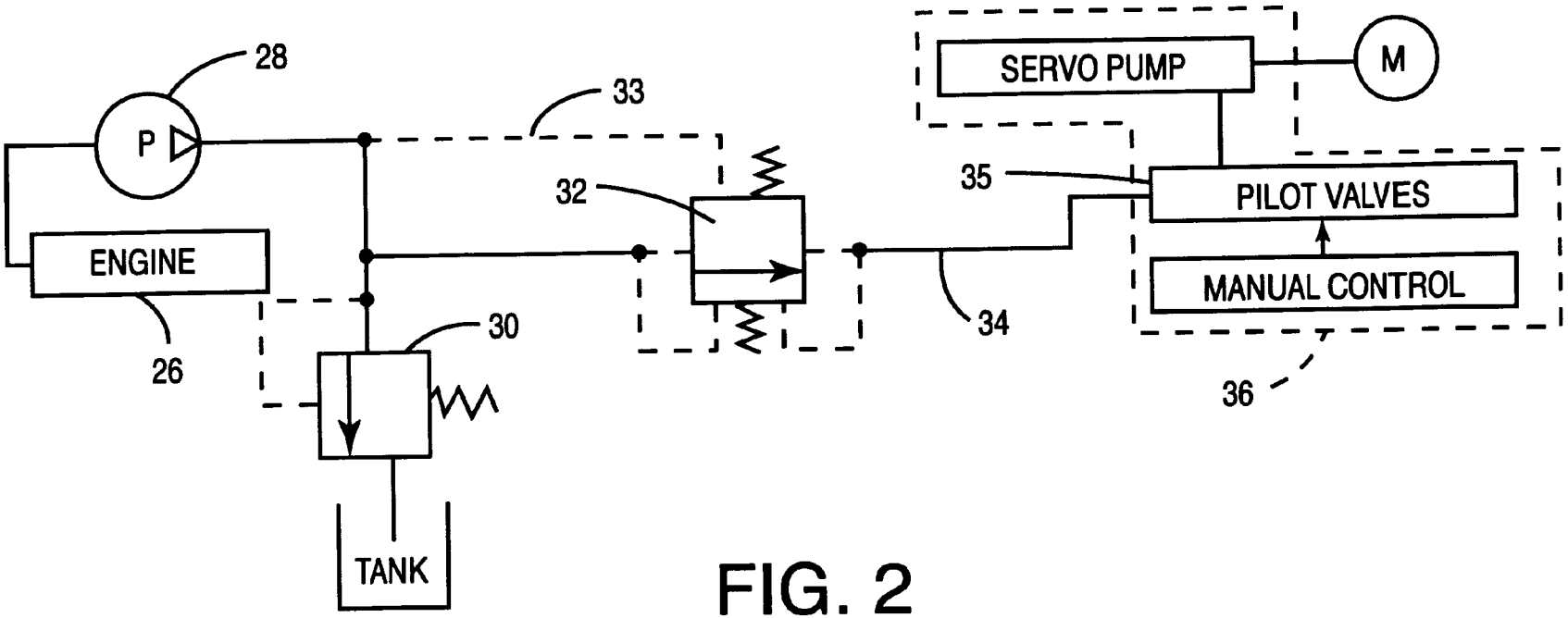
FIG. 2 PRIOR ART
FIG. 2 is a schematic representation of a prior art circuit for reducing the pilot pressure to pilot valves in a travel controller based upon pump speed.

FIGS. 1 and 2 illustrate prior art pilot valve/pilot pressure controls. FIG. 1 is a schematic representation of a joystick control for a hydraulic pilot pressure control for an excavator that utilizes pilot pressure operated valves for varying the speed of hydraulic motors driving the tracks for moving the excavator over the ground or implement functions. The hydraulic motors are controlled by proportional pilot operated valves or servos that in turn receive pilot pressure from pilot valves operated by a joystick. The hydraulic circuit includes a piston pump 10 driven from an engine 12 of an excavator, and a pressure reducing valve that is of standard design shown at 14 provides a pilot pressure along a line 16 to an on/off manually controlled solenoid valve 18 that is controlled by the excavator operator. When the solenoid valve 18 is off, pilot valves 21 controlled by a joystick 20 of conventional design are inoperative. That means that pilot operated travel control valves 22 or other desired controls normally operated in response to pilot pressure from the joystick controller will not function and no travel is possible. When the solenoid valve 18 is on, the pressure in line 16 is provided to the pilot valves 21 at the joystick at all levels of flow. The joystick provides pilot pressure through pilot valves 21 to main pilot operated variable control valves or servos such as that shown at 22 which in turn then provides a variable flow from the pump to the travel motors 24.

A second prior art hydraulic schematic is shown in FIG. 2, and is used in vehicles such as a skid steer loader at the present time. An engine 26 drives a positive displacement pump 28 of suitable design. The hydraulic system has a relief valve 30 in the pump output circuit. The output from the pump 28 also is provided through a pressure reducing valve 32 which has an output line 34 providing pilot pressure to pilot valves 35 of pilot valve travel controller 36 that can be of conventional design, and not necessarily a joystick type controller. In other words the travel controller 36 could use various hand controls, such as the operator levers of a skid steer loader. The pump flow to the drive or travel motors is provided in a normal manner which may include a servo controlled pump providing a proportional output flow to the drive motors.

The reducing valve 32 is connected to receive a signal indicating pump speed along a line 33. The reducing valve will provide a pilot pressure on line 34 that is proportional to the pump speed. As pump speed drops, the pilot pressure on line 34 is reduced, and thus the pilot valve 35 at the controllers 36 that provide pilot pressure to pilot operated travel valves will be controlled to provide less pilot pressure for a given amount of displacement of the selected pilot valve 35, than if a higher pilot pressure is provided along line 34. As stated, sensing pump speed may result in an adjustment that is incorrect, such as when the engine is slowed down.

The prior art systems will tend to be susceptible to improperly sensing overloads to the hydraulic system that can stall the engine, if components such as boom cylinders, bucket cylinders, or other working components are requiring high horsepower, at the same time travel is initiated. By utilizing a pulse width modulating valve to provide the pilot pressure to pilot valves in a travel controller or a joystick, the system is controlled so that the flow to the travel motors will be reduced when other loads are causing the engine speed to drop or other input parameters to change in a negative manner.

Figure 3:
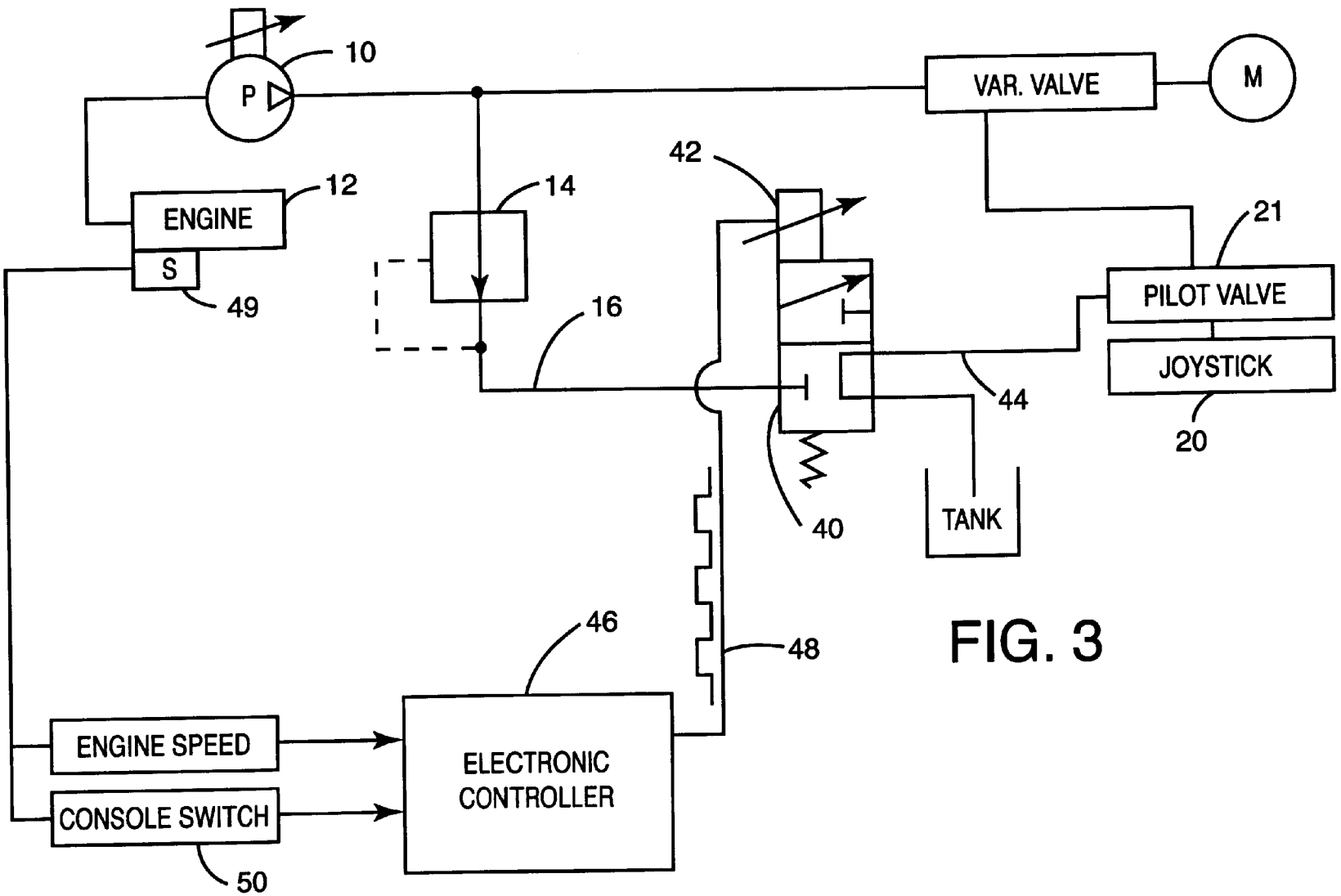
FIG. 3 is a schematic representation of a first form of the present invention used for controlling pilot pressure to a travel controller/joystick substantially as a function of engine speed.

The first form of the present invention is illustrated in the schematic diagram of FIG. 3, and is used in a similar drive motor application to that shown in the prior art illustrated in FIG. 1. In this case the engine 12 drives a conventional positive displacement piston pump 10, through a pressure reducing valve 14 so that the maximum pilot pressure on the line 16 is controlled to a level less than system relief pressure as previously shown. However, the on/off solenoid valve has been replaced with a pulse width modulating (PWM) valve 40, which opens an amount proportional to the pulsed signal on an input of a control solenoid 42. When the pulse width modulating valve is partially opened the pressure along a pilot pressure line 44 will be at a level that would be less than at a maximum opening. In other words, while the valve 40 can be shut off completely so that no flow would go to the pilot valves 21 controlled at joystick 20. As the engine speed increases, the valve 40 would open proportionally more so that a greater pressure and flow would be available on the pilot pressure line 44 to the pilot valves controlled by the joystick 20. The energization of the solenoid 42 is from a signal from an electronic controller 46 which provides an output pulse train along a control line 48 to the solenoid 42 as a function of input signals, specifically as shown, the input signal is proportional to engine speed as shown. The engine speed signal is obtained by a suitable sensor 49 of conventional design.

A console switch 50 on the operator's console provides an on/off control independent of the engine speed. The console switch 50 is an on/off switch to shut off the pilot pressure when it is desired to lock out the pilot valves and joystick control.

Thus, a pulse width modulating valve 40 provides a pilot pressure in response to a parameter which indicates the load on the engine 12. This in turn indicates horsepower requirement of the hydraulic system which includes actuation for the boom, dipper stick, bucket and other working components.

Figure 4:
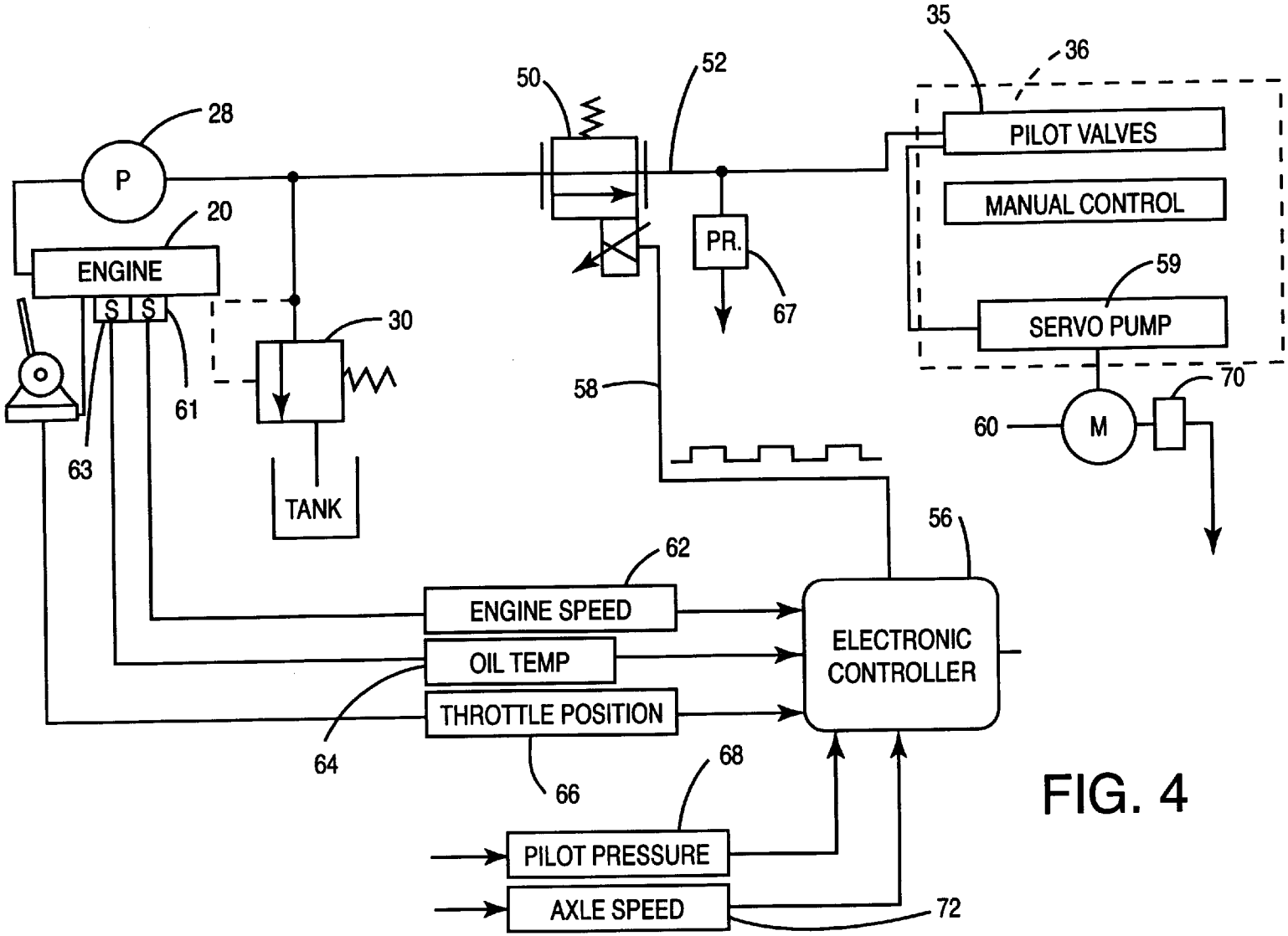
FIG. 4 is a second form of the present invention usable in place of the circuit shown in FIG. 3 for providing a variable pilot pressure to travel controllers based upon selected additional input functions.

FIG. 4 is a circuit embodying the present invention that is used in place of the prior art schematic shown in FIG. 2. In the skid steer loader application shown in FIG. 4, the pump 28 is driven by the engine 20 as previously explained, and a relief valve 30 remains in position in the pump output line. The reducing valve 32 has been replaced with a pulse width modulating (PWM) valve 50 of conventional design, that provides a hydraulic fluid output along a pilot pressure line 52 that is a function of the signal provided to a variable position control solenoid 54 from an electronic controller 56 along a line 58. The pilot pressure is provided along the line 52 to the pilot valves 35 of travel controller 36. The pilot valve, when opened provides the pilot pressure as set on line 52 to a servo piston pump or other servo controller 59 that drives a hydraulic motor 60, which is used for propelling the vehicle, such as a skid steer loader.

The electronic controller 56 provides an output pulse stream along the line 58 with the pulse width being a function of several selectable inputs in this form of the invention. An engine speed sensor 61 is connected to the engine and provides the engine speed signal 62 as an input to the electronic controller 56. Additional inputs from the engine can include oil temperature 64 from a sensor 63 and throttle position 66 all of which can be used in an algorithm to provide functions that control the pulse width of the signal along the line 58. Additionally, for closed loop control a feedback pilot pressure signal from a sensor 67 can be provided as indicated at 68 to the electronic controller 56. Axle speed from the drive motor 60 can be provided by a sensor 70, as indicated by the signal 72 as a feedback input to the electronic controller 56. The weight to be given the inputs can be selected to take into account all of the parameters that affect the horsepower requirements, so the reduction in pilot pressure by PWM valve 50 accurately reflects existing conditions.

The output of the electronic controller in both forms of the invention is a pulse train output. The width of the pulses are functions of the inputs that have been mentioned.

Other inputs can be used, where they would be an indication of the horsepower being consumed by the overall industrial vehicle, either a skid steer loader, regular loader, excavator, or similar industrial machine, so that the travel controllers or other selected hydraulic function controllers will be restricted (slowed) in order not to exceed the available horsepower and leave adequate horsepower for the working components such as the boom or lift arm assemblies of a loader, bucket controls, or the boom or dipper stick of an excavator. The pilot valves are coupled to known components that will control speed of the drive motors as a function of the pilot pressure.

Although the present invention has been described with reference to preferred embodiments, workers skilled in the art will recognize that changes may be made in form and detail without departing from the spirit and scope of the invention.

What is claimed is:

1. A pilot pressure controller connected in a hydraulic circuit of an industrial machine having a pump driven by a power source, a proportional output valve for controlling pressure from said pump to a pilot valve, said proportional output valve providing pressure to the pilot valve as a function of an electric signal, and an electronic controller having an input connected to receive a signal which is a function of the horsepower demand on the power source and providing the electric signal to the proportional valve as a function of the signal received at the electronic controller input.

2. The pilot pressure controller of claim 1, wherein said input to said electronic controller comprises a signal proportional to the rotational speed of the power source.

3. The pilot pressure controller of claim 1, wherein a joystick is coupled to control the pilot valve.

4. The pilot pressure controller of claim 1, wherein said proportional valve is a pulse width modulating valve providing an output as a function of a pulsed electrical signal from the electronic controller.

5. The pilot pressure controller of claim 4, wherein said electronic controller includes an input sensing oil temperature of the power source, and an input to receive at least one of the feedback signals consisting of actual pilot pressure on the output side of the proportional valve and speed of a drive motor being controlled by the controller.

6. The pilot pressure controller of claim 1, wherein the proportional valve is a pulse width modulated valve.

7. A pressure supply control system for a pilot valve having an input for receiving hydraulic fluid under pressure and an output for controlling pilot operated valves, a source of hydraulic fluid under pressure comprising a pump, an engine driving the pump, a pulse width modulated valve between the pump and the inlet of the pilot valve, and a controller having an input connected to sense at least one condition related to requirements of the engine for providing a control signal to the pulse width modulated valve comprising an output pulse train for controlling the output of the pulse width modulated valve as a function of horsepower requirements of the engine.

8. The system of claim 7, wherein said electronic controller provides an output that is a function of engine speed.

9. The system of claim 7, wherein said electronic controller provides an output that is based upon at least one of the signals comprising engine speed, throttle setting, and oil temperature of the engine.

10. The system of claim 7 and a pressure reducing valve between an outlet of the pump and the pulse width modulated valve.

11. The system of claim 9 and a feedback connected to said electronic controller comprising a signal representing one of the pilot pressure on the output side of the proportional valve, and rotational speed of a drive motor controlled by an output of the pilot valve.

* * * * *